US007604522B1

(12) United States Patent
Burnham, Jr.

(10) Patent No.: US 7,604,522 B1
(45) Date of Patent: Oct. 20, 2009

(54) HYDROFOIL BIKE APPARATUS

(76) Inventor: Lawrence E. Burnham, Jr., 2510 Deer Park Blvd., Middleburg, FL (US) 32068

( * ) Notice: Subject to any disclaimer, the term of this patent is extended or adjusted under 35 U.S.C. 154(b) by 0 days.

(21) Appl. No.: 12/364,904

(22) Filed: Feb. 3, 2009

(51) Int. Cl.
*B63B 35/85* (2006.01)

(52) U.S. Cl. ..... 441/72; 441/73

(58) Field of Classification Search ..... 441/72, 441/73; 114/253
See application file for complete search history.

(56) References Cited

U.S. PATENT DOCUMENTS

| | | | | |
|---|---|---|---|---|
| 2,814,811 | A | 12/1957 | Ritter, Jr., et al. | |
| 2,865,032 | A * | 12/1958 | Moody, Jr. | 441/72 |
| 3,145,030 | A | 8/1964 | Millis | |
| 3,156,935 | A | 11/1964 | Long | |
| 3,204,263 | A * | 9/1965 | Bash | 441/72 |
| 3,280,786 | A | 10/1966 | Rowell | |
| 3,394,673 | A | 7/1968 | Hamori | |
| 3,642,299 | A * | 2/1972 | Garcia | 280/16 |
| 3,799,565 | A * | 3/1974 | Burtis et al. | 280/16 |
| 4,082,304 | A * | 4/1978 | Kendrena | 280/28.15 |
| 4,204,581 | A * | 5/1980 | Husted | 180/190 |
| D349,740 | S | 8/1994 | Tabor | |
| 5,482,302 | A * | 1/1996 | Yu | 280/12.12 |
| 6,626,441 | B1 * | 9/2003 | Hanson | 280/7.14 |
| 6,736,414 | B2 * | 5/2004 | Farrally-Plourde | 280/16 |
| 6,994,359 | B1 * | 2/2006 | Silver | 280/16 |
| 7,232,133 | B2 * | 6/2007 | Stevens | 280/16 |

* cited by examiner

*Primary Examiner*—Stephen Avila

(57) ABSTRACT

The hydrofoil bike apparatus has a top frame member, a fork tube with a steerable fork within, a handlebar affixed atop the fork, a steered first foil affixed to the fork bottom, a center support first end affixed below the top frame member, a second foil disposed on the center support second end, the second foil substantially horizontally even with and directly behind the first foil, the first and second foils traveling slightly below the water surface with a rear foil atop the water, a third foil above and directly behind the second foil, a flotation member affixed to the fork tube, the center support, and the top member, the flotation member out of the water with the apparatus at speed, a seat atop the top frame member, a tow assembly with swiveling and adjustable pressure sensitive automatic release from an existing tow tope of an existing towing watercraft.

20 Claims, 8 Drawing Sheets

HYDROFOIL BIKE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various devices have been presented that are towed behind a powered watercraft. Such devices include skis, tubes, wave boards, and many others. The present towed hydrofoil bike apparatus uniquely provides a towed watercraft that most resembles in looks and function a motocross bike. The apparatus is towed behind an existing powered watercraft and enables a rider to ride over and through the water in a posture resembling that of a rider on a land bike.

FIELD OF THE INVENTION

The hydrofoil bike apparatus relates to towed watercraft and more especially to a hydrofoil bike apparatus that is towed behind a powered watercraft.

SUMMARY OF THE INVENTION

The general purpose of the hydrofoil bike apparatus, described subsequently in greater detail, is to provide a hydrofoil bike apparatus which has many novel features that result in an improved hydrofoil bike apparatus which is not anticipated, rendered obvious, suggested, or even implied by prior art, either alone or in combination thereof.

To attain this, the hydrofoil bike apparatus is a water bike that closely resembles the function of a land ridden bike, especially a motocross bike. The flotation board of the apparatus allows balance and flotation prior to the apparatus being towed. The floatation board further provides planing action for the apparatus until up to speed, whereupon the first and second foils ideally glide through the water just below the surface. The rear foil skims atop the water. The apparatus steers like a bike, with substantially conventional handlebar steering the first foil. The unique design of the foils provide for cutting through waves, thereby allowing the apparatus to be ridden in choppy water and through waves. The front foil is adjustable for plane angle so that various riders can be accommodated, due to differences in rider weights, sizes, styles, and the desired performance of the apparatus be dialed in to an individual's taste. The plane adjustment and foil designs provide for a novice rider to easily enjoy the sport, while simultaneously allowing an advanced rider to perform stunts and various feats and performance styles.

The unique safety release allows individual riders to adjust for release from the towing watercraft as desired, whether easily or with greater tension required for release, thereby ensuring safety and ultimate enjoyment. The most complete embodiment of the apparatus is made of various composites and alloys. All embodiments of the apparatus are made of lightweight materials. The apparatus is highly maneuverable and easily ridden.

The unique tow assembly offers significant advantages, among which is the swivel design which allows a tow rope to be at an angle to the apparatus, and not just straight ahead. The swivel rolls freely within the mount plates, thereby even allowing the apparatus to pass a towing watercraft, or to be at virtually any angle to the craft, whether in the water or airborne. Of great importance is the swivels independence from the steering of the front foil.

Thus has been broadly outlined the more important features of the improved hydrofoil bike apparatus so that the detailed description thereof that follows may be better understood and in order that the present contribution to the art may be better appreciated.

An object of the hydrofoil bike apparatus is to perform much like a land ridden bike.

Another object of the hydrofoil bike apparatus is to be easily ridden.

A further object of the hydrofoil bike apparatus is to be highly maneuverable.

An added object of the hydrofoil bike apparatus is to be adjustable for varied performance traits and riding styles and conditions.

And, an object of the hydrofoil bike apparatus is to be released automatically from a towing watercraft.

Still another object of the hydrofoil bike apparatus is to be adjustable for release pressure from a towing watercraft.

These together with additional objects, features and advantages of the improved hydrofoil bike apparatus will be readily apparent to those of ordinary skill in the art upon reading the following detailed description of presently preferred, but nonetheless illustrative, embodiments of the improved hydrofoil bike apparatus when taken in conjunction with the accompanying drawings.

In this respect, before explaining the current embodiments of the improved hydrofoil bike apparatus in detail, it is to be understood that the hydrofoil bike apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved hydrofoil bike apparatus. It is therefore important that the claims be regarded as including such equivalent constructions insofar as they do not depart from the spirit and scope of the hydrofoil bike apparatus. It is also to be understood that the phraseology and terminology employed herein are for purposes of description and should not be regarded as limiting.

FIG. **6*b*** is a top plan view of the safety release, unlatched.

Figure 2:
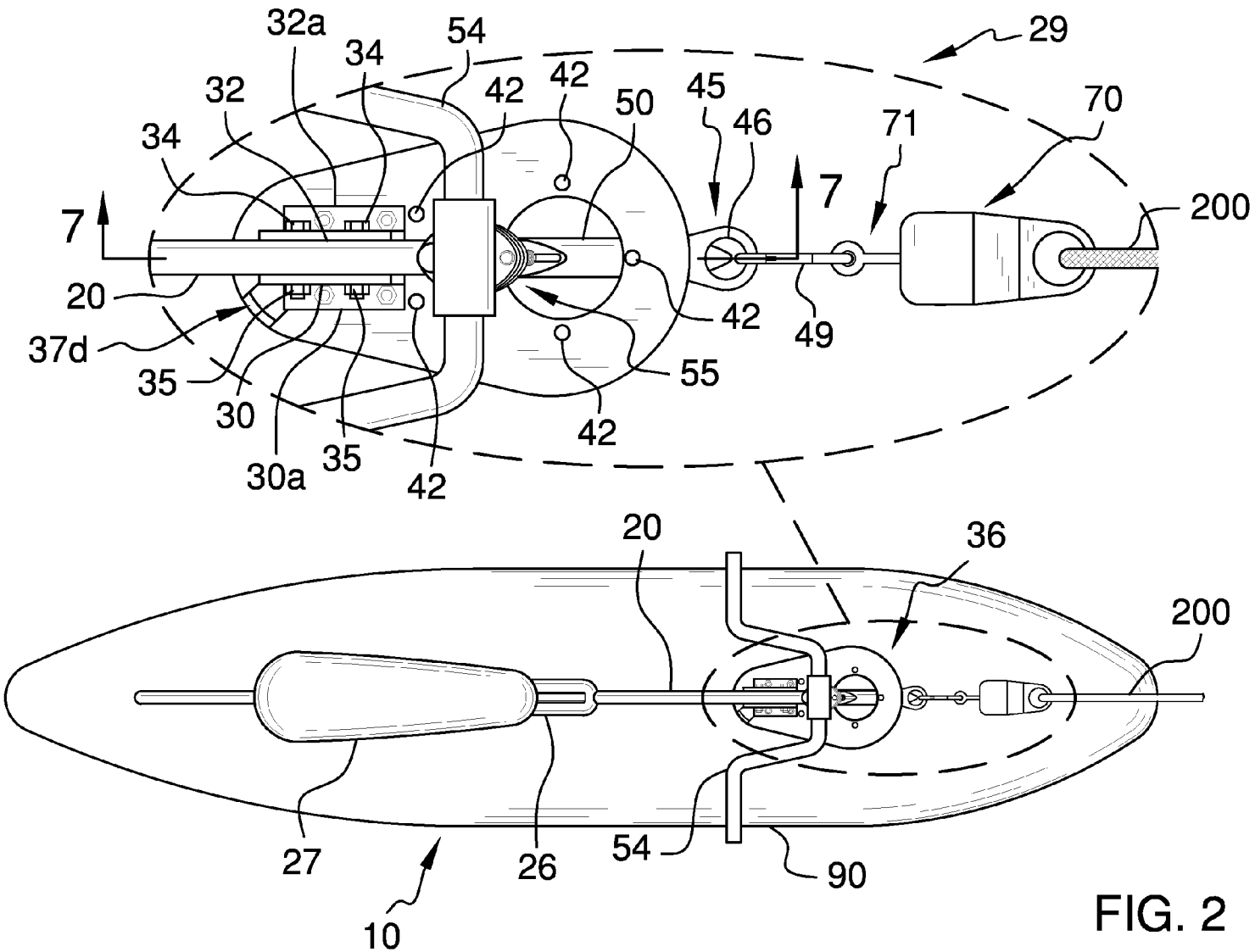
FIG. 2 is a top plan view with amplification of the tow assembly.
Figure 7:
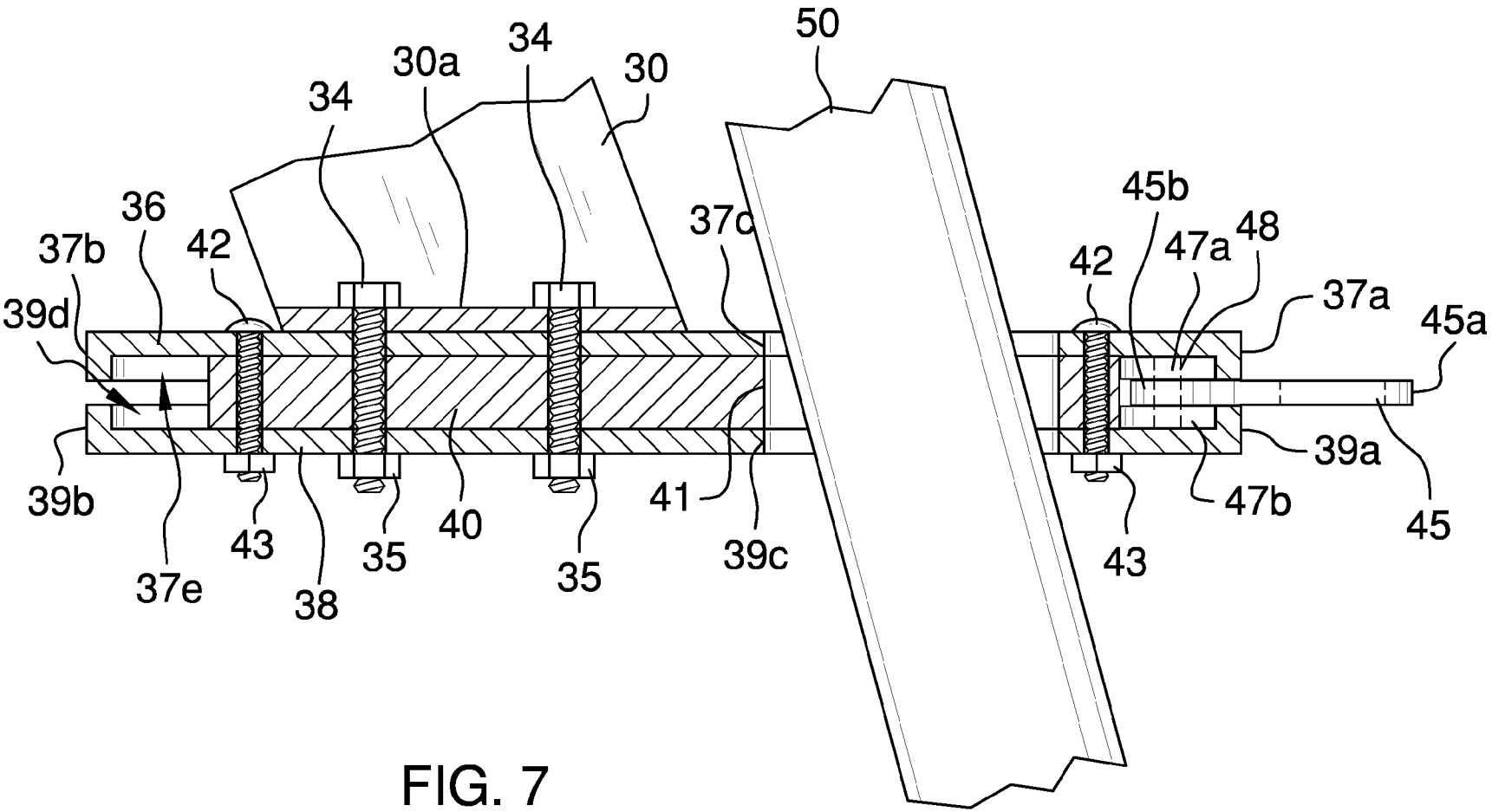

FIG. 7 is a partial cross sectional view of FIG. 2, taken along the line 7-7.

Figure 8:
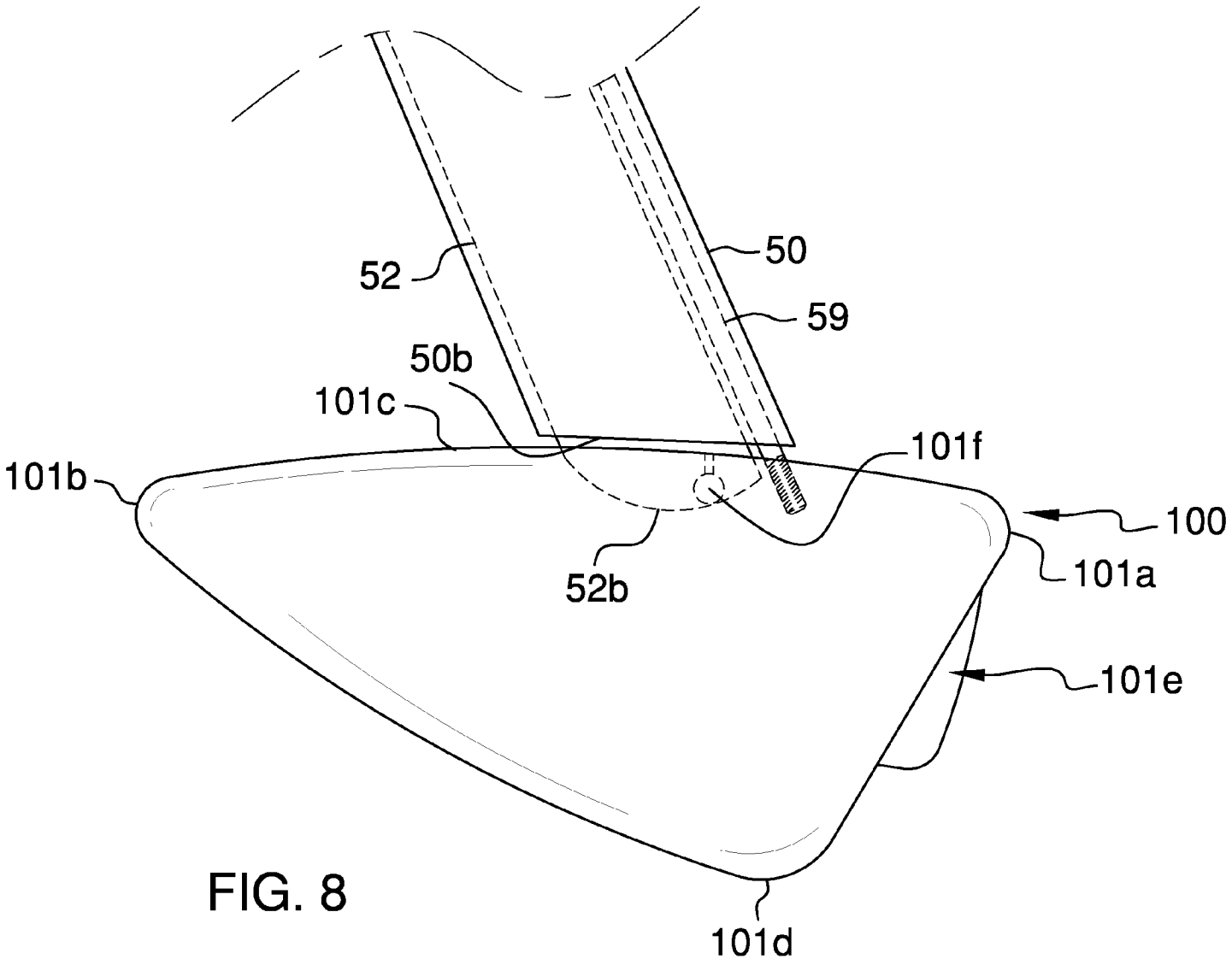

FIG. 8 is a lateral perspective view of the pivotal attachment of the first foil.

DETAILED DESCRIPTION OF THE DRAWINGS

With reference now to the drawings, and in particular FIGS. 1 through 8 thereof, the principles and concepts of the hydrofoil bike apparatus generally designated by the reference number 10 will be described.

Figure 1:
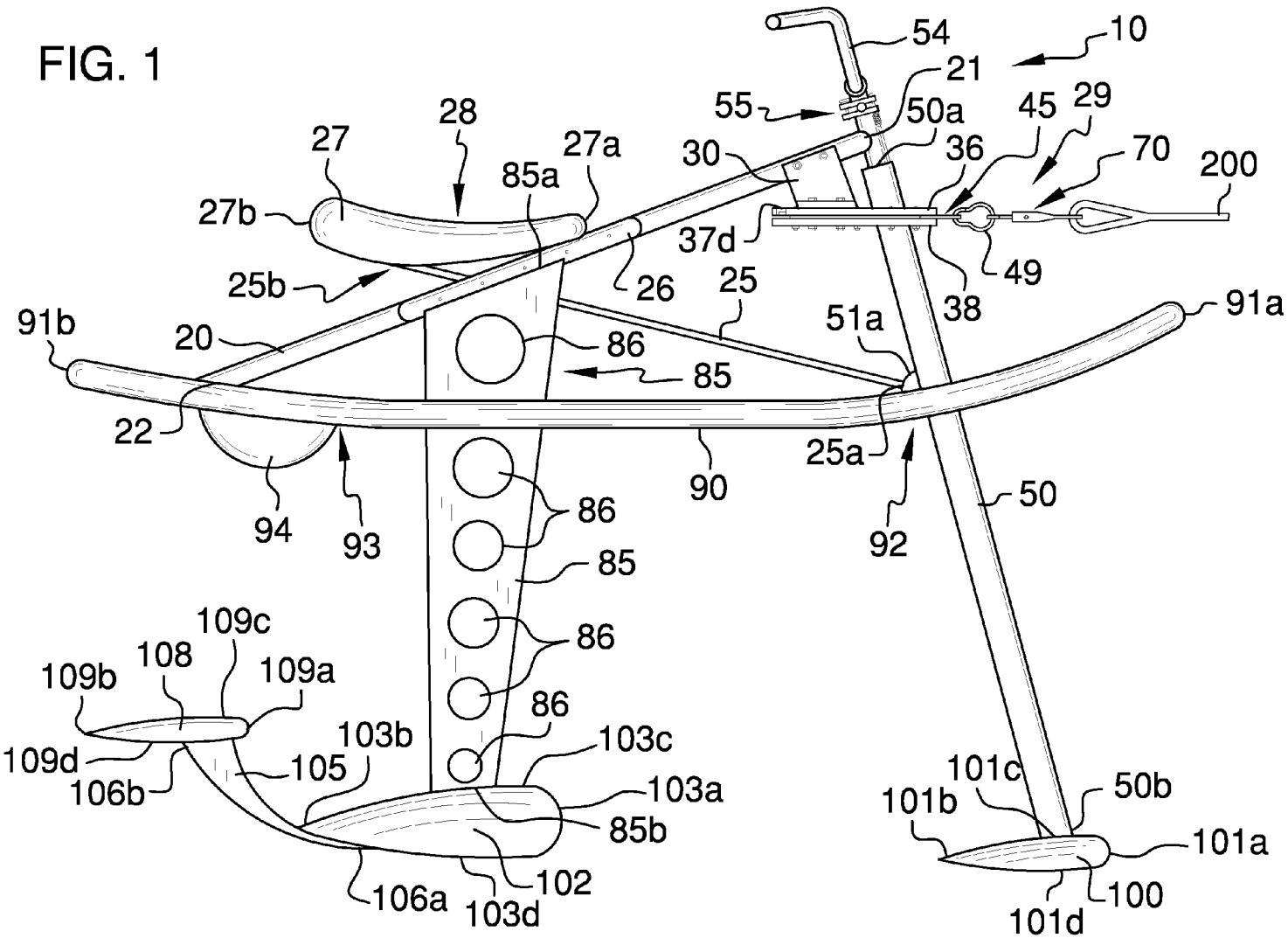
FIG. 1 is a lateral elevation view.

Referring to FIG. 1, the apparatus 10 is designed for top water travel over any water surface. The existing tow rope 200 of a water craft tow vehicle, such as a boat or Jet Ski™ for example, is selectively attached to the tow assembly 29. The apparatus 10 allows a rider to sit on the seat 27 and selectively rest feet on the flotation member 90 in preparation of being towed.

The flotation member first end 91*a* is elevated above the water surface prior to towing by the front upward curve 92 to assist in planning at take off and getting the apparatus 10 up to plane at speed. At speed, the first foil 100, and second foil 102 are best utilized by adjusting the trim adjustment assembly 55 such that the rear foil 108 is atop the water and the first foil 100 and second foil 102 cut through the water slightly under the water surface. This enables the apparatus 10 to ride through waves and chop successfully.

Referring further to FIG. 1, the apparatus 10 comprises, in combination, the top frame member 20 having a top member first end 21 spaced apart from a top member second end 22. The top member second end 22 is at a height below a height of the top member first end 21. The seat support 26 is affixed to about the center of the top frame member 20. The seat 27 has a seat front 27*a* spaced apart from a seat rear 27*b*. The top seat concavity 28 is disposed between the seat front 27*a* and the seat rear 27*b*. The seat front 27*a* is pivotally attached to the seat support 26. The center support 85 has a center support first end 85*a* spaced apart from a center support second end 85*b*. The center support first end 85*a* is affixed downwardly to the seat support 26. The center support first end 85*a* has a width greater than the width of the center support second end 85*b*. A plurality of spaced apart support orifices 86 is disposed within the center support 85 between the center support first end 85*a* and the center support second end 85*b*. The hollow fork tube 50 has a tube first end 50*a* spaced apart from a tube second end 50*b*. The tube first end 50*a* is affixed to the top member first end 21.

The flotation member 90 has a flotation member first end 91*a* spaced apart from a flotation member second end 91*b*, a width, and a front upward curve 92 disposed proximal to the flotation member first end 91*a*. The rear upward curve 93 is disposed proximal to the flotation member second end 91*b*. The front upward curve 92 is greater than the rear upward curve 93. The flotation member 90 is affixed to the center support 85. The flotation member 90 is further affixed to about the center of the fork tube 50. The substantially semi-circular stabilizing fin 94 is disposed downwardly from the flotation member 90. The stabilizing fin 94 is proximal to the flotation member second end 91*b*. The tube gusset 51*a* is affixed to the fork tube 50 and atop the flotation member 90. The seat support rod 25 has a rod first end 25*a* spaced apart from a rod second end 25*b*. The rod first end 25*a* is affixed to the tube gusset 51*a*. The rod second end 25*b* is adjustably affixed to the seat 27 proximal to the seat rear 27*b*. The fork 52 is rotatably housed within the fork tube 50 via at least one bushing 53. Preferably, more bushings 53 (not shown) are disposed along the interior length of the fork tube 50. The fork 52 has a fork first end 52*a* spaced apart from a fork second end 52*b*. The fork first end 52*a* is proximal to the top member first end 21 of the top frame member 20.

Figure 3:
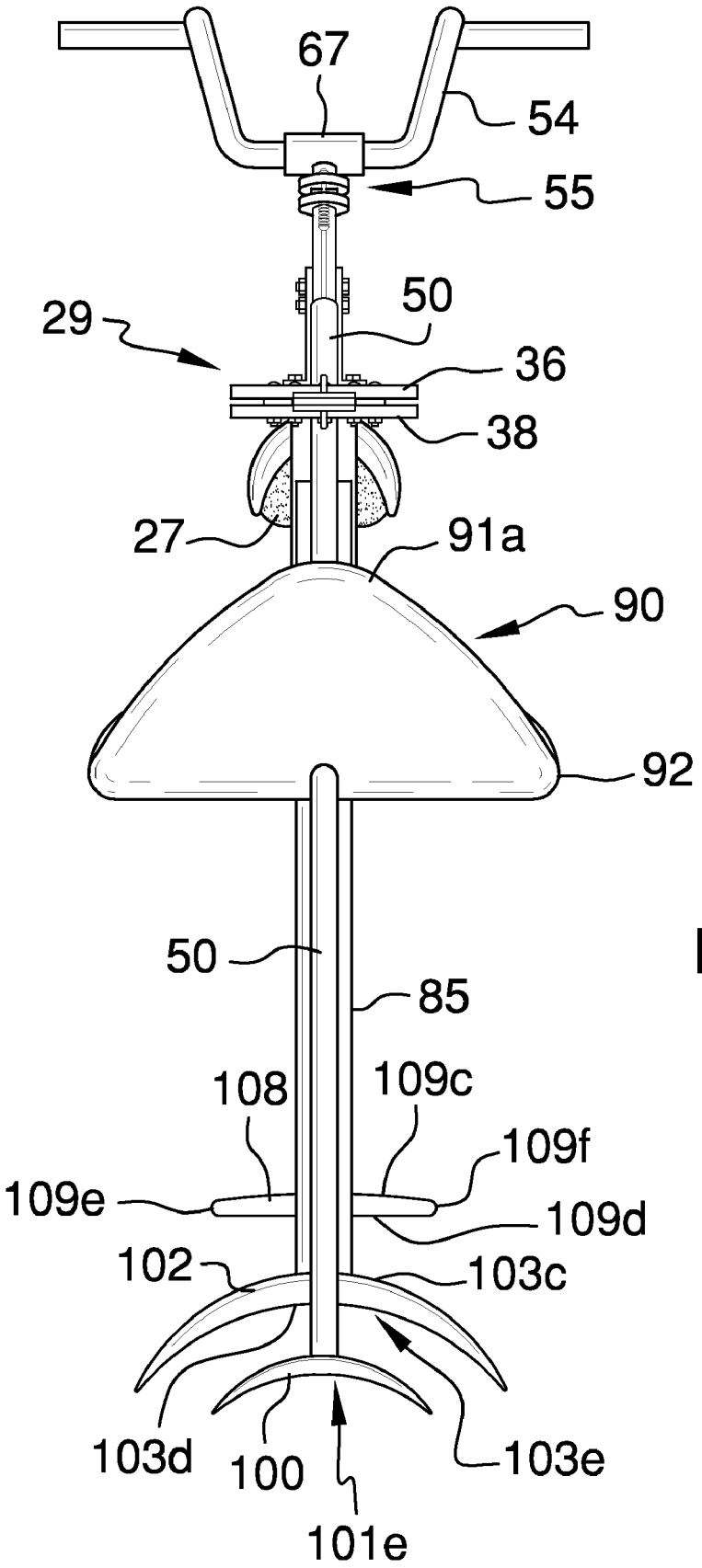
FIG. 3 is a front elevation view.
Figure 4:
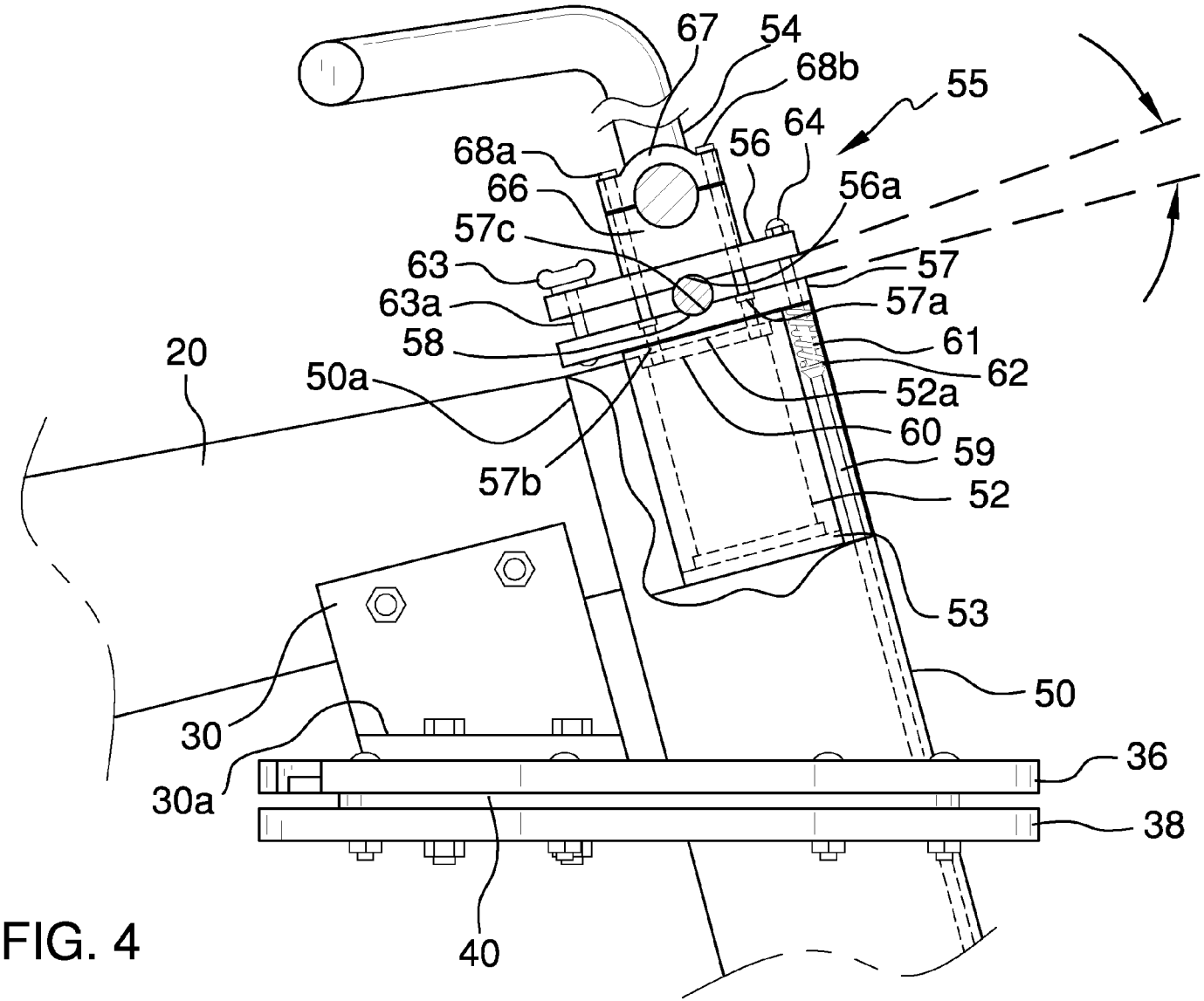
FIG. 4 is a lateral elevation view of the trim adjustment

Referring to FIGS. 3, 4, and 8, the fork mount 60 is affixed to the fork first end 52*a*. The trim adjustment assembly 55 is affixed atop the fork 52. The trim adjustment assembly 55 comprises a bottom adjustment plate 57 affixed to the fork mount 60 by the first plate screw 57*a* and the second plate screw 57*b*. A bottom plate groove 57*c* is disposed within the bottom adjustment plate 57.

The top adjustment plate 56 is disposed above and spaced apart from the bottom adjustment plate 57. The top plate groove 56*a* is disposed within the top adjustment plate 56 directly opposite from the bottom plate groove 57*c*. The plate pivot 58 is disposed within the grooves of the top adjustment plate 56 and the bottom adjustment plate 57. The knob bolt 63*a* adjustably affixes the rear of the top adjustment plate 56 to the rear of the bottom adjustment plate 57. The adjustment knob 63 controls positioning of the rear of the top adjustment plate 56 relative to the rear of the bottom adjustment plate 57. The linkage rod 59 is passed through and adjustably secures the front of the top adjustment plate 56 to the front of the bottom adjustment plate 57 by the rod nut 64. The linkage rod 59 is extended to a point below the fork second end 52*b*. The spring seat 62 is disposed on the linkage rod 59 below the bottom adjustment plate 57. A compression spring 61 is disposed between the spring seat 62 and the bottom adjustment plate 57. The handlebar mount 66 is affixed atop the top adjustment plate 56. The clamp 67 is selectively affixed atop the handlebar mount 66 via a first handlebar bolt 68*a* and a second handlebar bolt 68*b*. The handlebar 54 is adjustably affixed between the handlebar mount 66 and the clamp 67. Loosening the clamp 67 allows positioning the handlebar 54 as desired prior to retightening. The first foil 100 has a rounded first foil first end 101*a* spaced apart from a tapered first foil second end 101*b*. The first foil top 101*c* is spaced apart from the first foil bottom 101*d*. The first foil concavity 101*e* is disposed within the first foil bottom 101*d*. The pivot 101*f* is disposed in the first foil top 101*c* and affixed to the fork second end 52*b*. The first foil top 101*c* is affixed to the linkage rod 59.

The trim adjustment assembly 55 thereby selectively establishes a plane angle of the first foil 100 via the adjustment knob 63 which selectively elevates or lowers the first foil first end 101*a*. The second foil 102 has a rounded second foil first end 103*a* spaced apart from a tapered second foil second end 103*b*. The second foil top 103*c* is spaced apart from the second foil bottom 103*d*. The second foil concavity 103*e* is disposed within the second foil bottom 103*d*. The second foil 102 is affixed to the center support second end 85*b*. The second foil 102 is substantially level with and directly behind the first foil 100.

Referring again to FIG. 1, the connecting fin 105 has a fin first end 106*a* spaced apart from a vertically higher fin second end 106*b*. The fin first end 106*a* is affixed to the second foil bottom 103*d* second foil second end 103*b*. The rear foil 108 has a rear foil first end 109*a* spaced apart from a rear foil second end 109*b* and a rear foil top 109*c* spaced apart from a rear foil bottom 109*d*. The rear foil bottom 109*d* is affixed to the connecting fin second end 106*b*. The rear foil 108 is positioned above and directly behind the second foil 102. The rear upward curve 93 of the flotation member 90 is affixed to the top member second end 22.

Figure 6A:
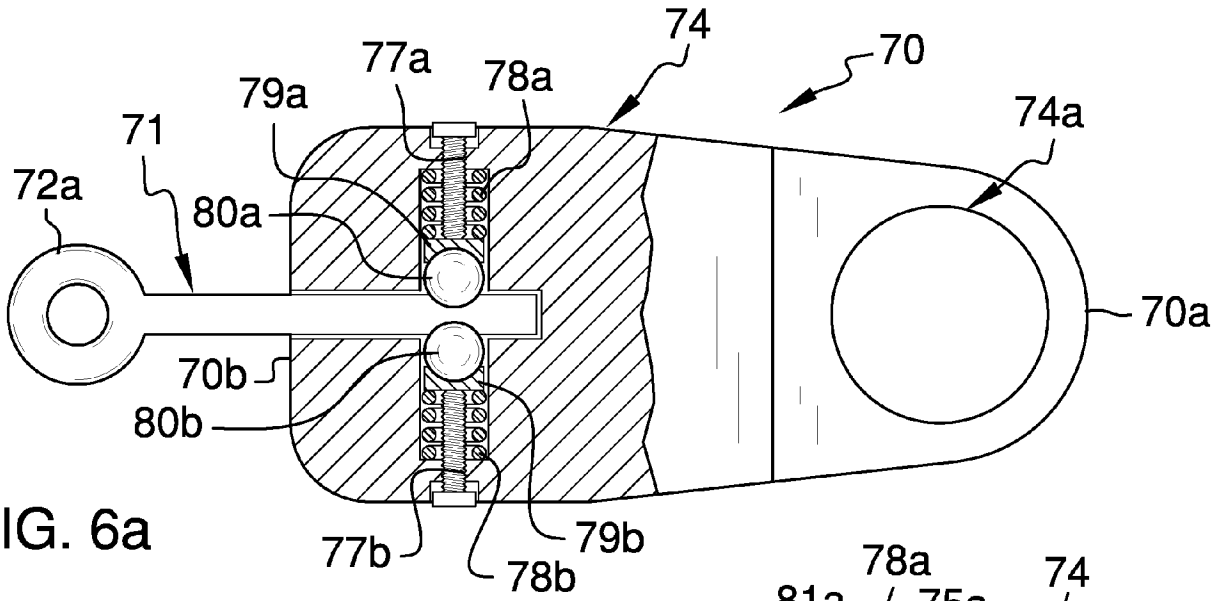
FIG. 6 is a top plan view of the safety release, latched.
Figure 6B:
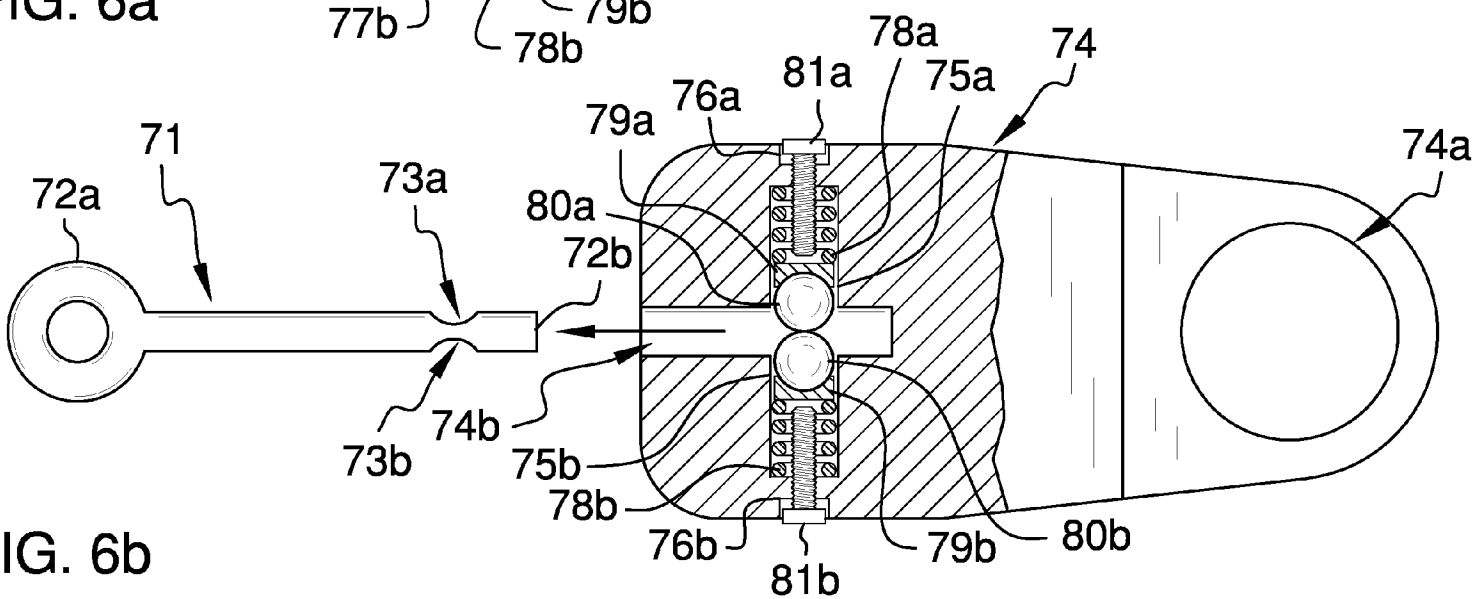

Referring to FIGS. 2, 6*a*, and 6*b*, the tow assembly 29 selectively connects the apparatus 10 to an existing tow rope 200. The tow assembly 29 partially comprises the safety release 70. The safety release 70 has a release first end 70*a* spaced apart from the release second end 70*b* and a length therebetween. The rope orifice 74*a* is disposed within the release first end 70*a*. The pin foramen 74*b* is disposed within the release second end 70*b*. The pin foramen 74*b* is parallel with the safety release 70 length.

A pair of opposed cylinders is openly, perpendicularly, and oppositely connected to either side of the pin foramen 74*b*. The cylinders comprise the first cylinder 75*a* and the second cylinder 75*b*. The first ball 80*a* is moveably disposed within the first cylinder 75*a* and partially within the pin foramen 74*b*. A partially elliptical first ball follower 79*a* is slideably disposed within the first cylinder 75*a* against the first ball 80*a*. The first spring 78*a* is disposed within the first cylinder 75*a* against the first ball 80*a*. The first thread 77*a* is disposed laterally within the safety release 70 in communication with the first cylinder 75*a*. The first recess 76*a* is disposed laterally adjacent to the first thread 77*a*. The first adjustment screw 81*a* is disposed within the first recess 76*a* and the first thread 77*a*. The first adjustment screw 81*a* establishes a selected tension against the first spring 78*a*. The second ball 80*b* is moveably disposed within the second cylinder 75*b* and partially within the pin foramen 74*b*. The partially elliptical second ball follower 79*b* is slideably disposed within the second cylinder 75*b* against the second ball 80*b*. The second spring 78*b* is disposed within the second cylinder 75*b* against the second ball 80*b*. The second thread 77*b* is disposed laterally within the safety release 70 in communication with the second cylinder 75*b*. The second recess 76*b* is disposed laterally adjacent to the second thread 77*b*. The second adjustment screw 81*b* is disposed within the second recess 76*b* and the second thread 77*b*. The second adjustment screw 81*b* establishes a selected tension against the second spring 78*b*. The hook pin 71 has an eyelet end 72*a* spaced apart from a second end 72*b*. A pair of opposed detents is disposed proximal to the second end 72*b*. The detents comprise the first detent 73*a* and the second detent 73*b*.

The first detent 73*a* is in removable receipt of the first ball 80*a* of the safety release 70. The second detent 73*b* is in removable receipt of the second ball 80*b* of the safety release 70. By adjusting the adjustment screws inwardly, more pressure is applied to retain the balls within the detents, thereby making the hook pin 71 more difficult to remove from the pin foramen 74*b*. Conversely, less tension on the springs and hence the balls relaxes spring tensions and allows easier removal of the hook pin 71 from the pin foramen 74*b*. This allows users to adjust the safety release 70 to accommodate different sizes, weights, and skill levels of riders.

Figure 5:
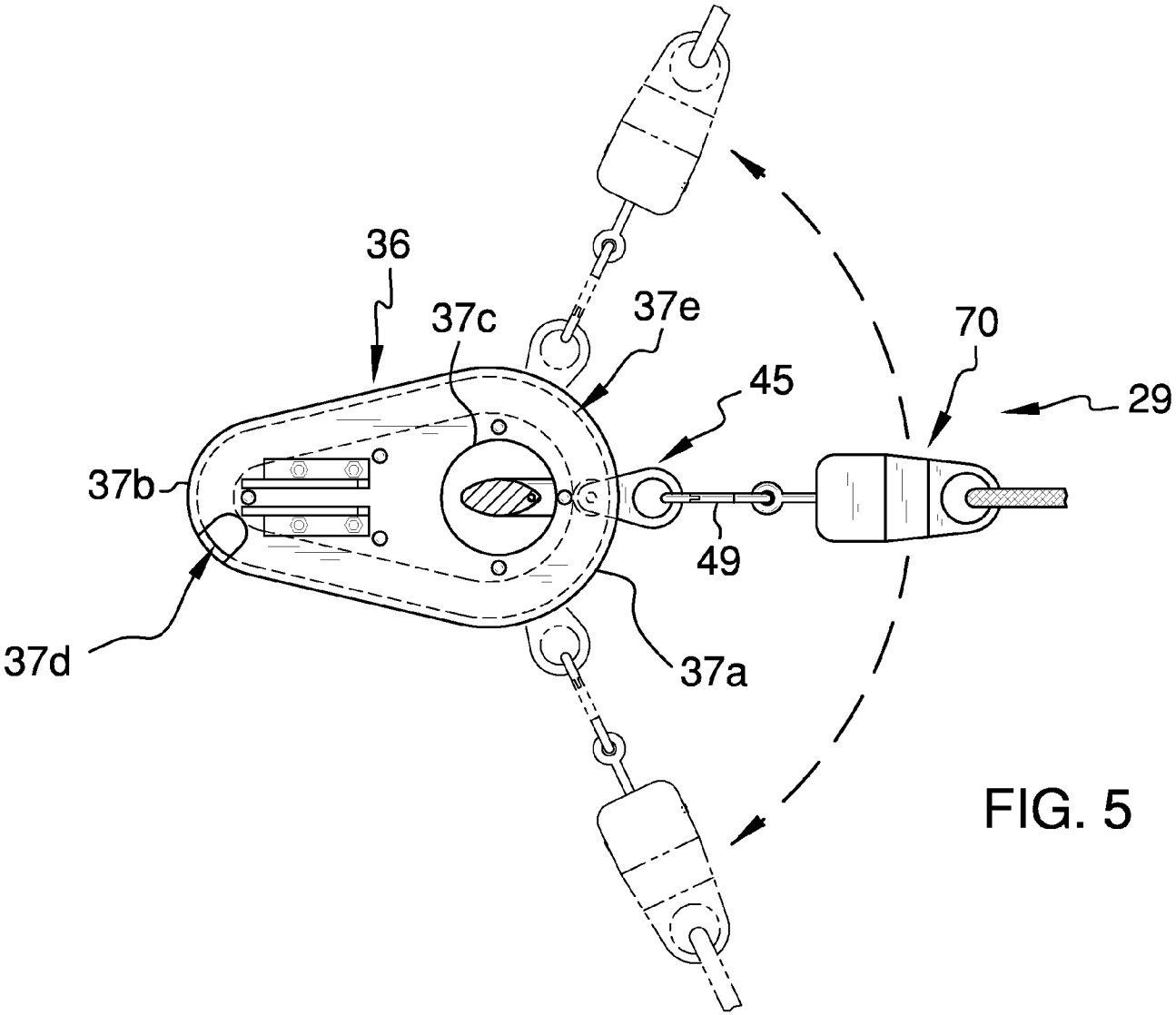
FIG. 5 is a top plan view of the tow assembly.

Referring to FIGS. 2, 5, and 7, the swivel 45 has a swivel first end 45*a* spaced apart from the swivel second end 45*b*. The swivel eyelet 46 is disposed in the swivel first end 45*a*. The hook ring 49 selectively attaches the swivel eyelet 46 to the hook pin 71 eyelet end 72*a*. The pair of flat round rollers is affixed on opposite sides of the swivel second end 45*b*. The rollers comprise the first roller 47*a* and the second roller 47*b*. The rollers are affixed by the swivel pin 48. The pair of opposed oblong mirror image plates comprise the top plate 36 and the bottom plate 38. The top plate 36 has a top plate front 37*a* spaced apart from the top plate rear 37*b*. The top interior channel 37*e* is disposed downwardly within the top plate 36. The top plate orifice 37*c* is proximal to the top plate front 37*a*. The fork tube 50 passes freely through the top plate orifice 37*c*. An insert port 37*d* is disposed within the top plate 36 proximal to the top plate rear 37*b*. The bottom plate 38 has a bottom plate front 39*a* spaced apart from the bottom plate rear 39*b*. The bottom interior channel 39*d* is upwardly disposed within the bottom plate 38. The bottom plate orifice 39*c* is proximal to the bottom plate front 39*a*.

The fork tube 50 passes freely through the bottom plate orifice 39*c*. The spacer 40 is disposed between the top plate 36 and the bottom plate 38. The spacer 40 is substantially within a center of the plates, thereby leaving a portion of the channels proximal to the plate perimeters. The plates and spacer 40 are held together by the plurality of spaced apart carriage bolts 42 secured by carriage nuts 43. The spacer orifice 41 is disposed between the top plate orifice 37*c* and the bottom plate orifice 39*c*. The fork tube 50 passes freely through the spacer orifice 41. The first roller 47*a* is held above the swivel second end 45*b* and the second roller 47*b* is held below the swivel second end 45*b* by the swivel pin 48. The rollers of the swivel 45 are selectively inserted into the insert port 37*d* of the top plate 36. The rollers travel freely within the channels of the top plate 36 and the bottom plate 38. The first mount lateral 30*a* is affixed atop the top plate 36. The first mount vertical 30 is affixed perpendicularly upward to the first mount lateral 30*a*. The first mount vertical 30 is affixed to the top frame member 20 proximal to the top member first end 21. The second mount lateral 32*a* is affixed atop the top plate 36. The second mount vertical 32 is affixed perpendicularly to the second mount lateral 32*a*. The second mount vertical 32 is identical to the first mount vertical 30. The second mount vertical 32 is affixed to the top frame member 20 proximal to the top member first end 21. The mount verticals are affixed to the top frame member 20 by two identical spaced apart mount bolts 34 secured by mount nuts 35.

With respect to the above description then, it is to be realized that the optimum dimensional relationships for the parts of the hydrofoil bike apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the hydrofoil bike apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the hydrofoil bike apparatus may be used.

Therefore, the foregoing is considered as illustrative only of the principles of the hydrofoil bike apparatus. Further, since numerous modifications and changes will readily occur to those skilled in the art, it is not desired to limit the hydrofoil bike apparatus to the exact construction and operation shown and described, and accordingly, all suitable modifications and equivalents may be resorted to, falling within the scope of the hydrofoil bike apparatus.

What is claimed is:

1. A hydrofoil bike apparatus, comprising:

a top frame member having a top member first end spaced apart from a top member second end;

a fork tube affixed downwardly from a the top member first end;

a steerable fork disposed pivotally within the fork tube, the fork having a fork first end exceeding an upper length of the fork tube, the fork first end spaced apart from a fork second end exceeding a lower length of the fork tube;

a handlebar affixed atop the fork first end;

a first foil affixed to the fork second end, the first foil traveling slightly below a water surface of an existing water;

a center support having a center support first end spaced apart from a center support second end, the center support first end affixed below the top frame member, the center support disposed between the top member first end and the top member second end;

a second foil disposed on the center support second end, the second foil larger than the first foil, the second foil substantially horizontally even with the first foil, the second foil directly behind the first foil, the second foil traveling slightly below the water surface;

a flotation member affixed to about a center of a length of the fork tube, the flotation member further affixed to the center support between the center support first end and the center support second end, the flotation member further affixed to the top member second end, the flotation member out of the water when the first foil and second foil are traveling slightly below the water;

a seat affixed atop the top frame member, the seat proximal to the center support;

a connecting fin having a fin first end spaced apart from a fin second end, the fin first end affixed below the second foil, the fin second end behind and above the second foil;

a rear foil affixed to the fin second end, the rear foil positioned above and directly behind the second foil, the rear foil skimming the surface of the water;

means for attaching an existing tow tope of an existing towing watercraft to the front fork tube.

2. The apparatus according to claim 1 wherein the means for attaching an existing tow rope further comprises automatic pressure sensitive release of the apparatus from the tow rope.

3. The apparatus according to claim 2 wherein the automatic pressure sensitive release of the apparatus from the two rope is further pressure adjustable.

4. The apparatus according to claim 1 wherein the flotation member further comprises a stabilizing fin affixed below the flotation member proximal to the rear upward curve.

5. The apparatus according to claim 1 wherein the flotation member further comprises a stabilizing fin affixed below the flotation member proximal to the rear upward curve.

6. The apparatus according to claim 2 wherein the flotation member further comprises a stabilizing fin affixed below the flotation member proximal to the rear upward curve.

7. The apparatus according to claim 3 wherein the flotation member further comprises a stabilizing fin affixed below the flotation member proximal to the rear upward curve.

8. A hydrofoil bike apparatus, comprising:

a top frame member having a top member first end spaced apart from a top member second end;

a fork tube affixed downwardly from a the top member first end;

a steerable fork disposed pivotally within the fork tube, the fork having a fork first end exceeding an upper length of the fork tube, the fork first end spaced apart from a fork second end exceeding a lower length of the fork tube;

a handlebar affixed atop the fork first end;

a first foil affixed to the fork second end, the first foil traveling slightly below a water surface of an existing water;

a trim adjustment assembly selectively adjusting the horizontal angle of the first foil, the trim adjustment assembly proximal to the handlebar;

a center support having a center support first end spaced apart from a center support second end, the center support first end affixed below the top frame member, the center support disposed between the top member first end and the top member second end;

a second foil disposed on the center support second end, the second foil larger than the first foil, the second foil substantially horizontally even with the first foil, the second foil directly behind the first foil, the second foil traveling slightly below the water surface;

a flotation member having a flotation member first end spaced apart from a flotation member second end;

a front upward curve proximal to the flotation member first end, the front upward curve affixed to about a center of a length of the fork tube;

a rear upward curve proximal to the flotation member second end; the rear upward curve affixed to the top member second end of the top frame member, the flotation member affixed to the center support between the center support first end and the center support second end, the flotation member out of the water when the first foil and second foil are traveling slightly below the water;

a seat affixed atop the top frame member, the seat proximal to the center support;

a connecting fin having a fin first end spaced apart from a fin second end, the fin first end affixed below the second foil, the fin second end behind and above the second foil;

a rear foil affixed to the fin second end, the rear foil positioned above and directly behind the second foil, the rear foil skimming the surface of the water;

means for attaching an existing tow tope of an existing towing watercraft to the front fork tube.

9. The apparatus according to claim 8 wherein the means for attaching an existing tow rope further comprises automatic pressure sensitive release from the towing watercraft.

10. The apparatus according to claim 9 wherein the automatic pressure sensitive release from the towing watercraft is further pressure adjustable.

11. The apparatus according to claim 8 wherein the flotation member further comprises a stabilizing fin affixed below the flotation member proximal to the rear upward curve.

12. The apparatus according to claim 9 wherein the flotation member further comprises a stabilizing fin affixed below the flotation member proximal to the rear upward curve.

13. The apparatus according to claim 10 wherein the flotation member further comprises a stabilizing fin affixed below the flotation member proximal to the rear upward curve.

14. The apparatus according to claim 8 wherein the means for attaching an existing tow tope of an existing towing watercraft to the front fork tube further comprises a swivel swiveling freely about the front fork tube.

15. The apparatus according to claim 9 wherein the means for attaching an existing tow tope of an existing towing watercraft to the front fork tube further comprises a swivel swiveling freely about the front fork tube.

16. The apparatus according to claim 10 wherein the means for attaching an existing tow tope of an existing towing watercraft to the front fork tube further comprises a swivel swiveling freely about the front fork tube.

17. The apparatus according to claim 11 wherein the means for attaching an existing tow tope of an existing towing watercraft to the front fork tube further comprises a swivel swiveling freely about the front fork tube.

18. The apparatus according to claim 12 wherein the means for attaching an existing tow tope of an existing towing watercraft to the front fork tube further comprises a swivel swiveling freely about the front fork tube.

19. The apparatus according to claim 13 wherein the means for attaching an existing tow tope of an existing towing watercraft to the front fork tube further comprises a swivel swiveling freely about the front fork tube.

20. A hydrofoil bike apparatus, comprising, in combination:

a top frame member having a top member first end spaced apart from a top member second end, the top member second end at a height below a height of the top member first end;

a seat support affixed to about a center of the top frame member;

a seat having a seat front spaced apart from a seat rear, a top seat concavity between the seat front and the seat rear, the seat front pivotally attached to the seat support;

a center support having a center support first end spaced apart from a center support second end, the center support first end affixed downwardly to the seat support, the center support first end having a width greater than a width of the center support second end;

a plurality of spaced apart support orifices disposed within the center support between the center support first end and the center support second end;

a hollow fork tube having a tube first end spaced apart from a tube second end, the tube first end affixed to the top member first end;

a flotation member having flotation member first end spaced apart from a flotation member second end, a width, a front upward curve disposed proximal to the flotation member first end, a rear upward curve disposed proximal to the flotation member second end, the front upward curve greater than the rear upward curve, the flotation member affixed to the center support, the flotation member further affixed to about a center of the fork tube, the rear upward curve affixed to the top member second end;

a substantially semicircular stabilizing fin disposed downwardly from the flotation member, the stabilizing fin proximal to the flotation member second end;

a tube gusset affixed to the fork tube and atop the flotation member;

a seat support rod having a rod first end spaced apart from a rod second end, the rod first end affixed to the tube gusset, the rod second end adjustably affixed to the seat proximal to the seat rear;

a fork rotatably housed within the fork tube via an at least one bushing, the fork having a fork first end spaced apart from a fork second end, the fork first end proximal to the top member first end of the top frame member;

a fork mount affixed to the fork first end;

a trim adjustment assembly affixed atop the fork, the trim adjustment assembly comprising:

a bottom adjustment plate affixed to the fork mount;

a bottom plate groove disposed within the bottom adjustment plate;

a top adjustment plate disposed above and spaced apart from the bottom adjustment plate;

a top plate groove disposed within the top adjustment plate;

a plate pivot disposed within the grooves of the top adjustment plate and the bottom adjustment plate;

a knob bolt adjustably affixing a rear of the top adjustment plate to a rear of the bottom adjustment plate;

an adjustment knob controlling a positioning of the rear of the top adjustment plate relative to the rear of the bottom adjustment plate;

a linkage rod passed through and adjustably securing a front of the top adjustment plate to a front of the bottom adjustment plate, the linkage rod extended to a point below the fork second end;

a spring seat disposed on the linkage rod below the bottom adjustment plate;

a compression spring disposed between the spring seat and the bottom adjustment plate;

a handlebar mount affixed atop the top adjustment plate;

a clamp selectively affixed atop the handlebar mount via a first handlebar bolt and a second handlebar bolt;

a handlebar adjustably affixed between the handlebar mount and the clamp;

a first foil having a rounded first foil first end spaced apart from a tapered first foil second end, a first foil top spaced apart from a first foil bottom, a first foil concavity within the first foil bottom, a pivot in the first foil top affixed to the fork second end, the first foil top affixed to the linkage rod, the trim adjustment assembly thereby selectively establishing a plane angle of the first foil;

a second foil having a rounded second foil first end spaced apart from a tapered second foil second end, a second foil top spaced apart from a second foil bottom, a second foil concavity within the second foil bottom, the second foil affixed to the center support second end, the second foil directly behind the first foil, the second foil substantially level with the first foil;

a connecting fin having a fin first end spaced apart from a vertically higher fin second end, the fin first end affixed to the second foil bottom second foil second end;

a rear foil having a rear foil first end spaced apart from a rear foil second end, a rear foil top spaced apart from a rear foil bottom, the rear foil bottom affixed to the connecting fin second end, the rear foil positioned above and directly behind the second foil;

a tow assembly selectively connecting the apparatus to an existing tow rope, the tow assembly comprising:

a safety release having a release first end spaced apart from a release second end, a length therebetween;

a rope orifice disposed within the release first end;

a pin foramen disposed within the release second end, the pin foramen parallel with the safety release length;

a pair of opposed cylinders openly, perpendicularly, and oppositely connected to an either side of the pin foramen, comprising a first cylinder and a second cylinder;

a first ball moveably disposed within the first cylinder and partially within the pin foramen;

a partially elliptical first ball follower slideably disposed within the first cylinder against the first ball;

a first spring disposed within the first cylinder against the first ball;

a first thread disposed laterally within the safety release in communication with the first cylinder;

a first recess disposed laterally adjacent to the first thread;

a first adjustment screw disposed within the first recess and the first thread, the first adjustment screw establishing a selected tension against the first spring;

a second ball moveably disposed within the second cylinder and partially within the pin foramen;

a partially elliptical second ball follower slideably disposed within the second cylinder against the second ball;

a second spring disposed within the second cylinder against the second ball;

a second thread disposed laterally within the safety release in communication with the second cylinder;

a second recess disposed laterally adjacent to the second thread;

a second adjustment screw disposed within the second recess and the second thread, the second adjustment screw establishing a selected tension against the second spring;

a hook pin having an eyelet end spaced apart from a second end;

a pair of opposed detents disposed proximal to the second end comprising a first detent and a second detent, the first detent in removable receipt of the first ball of the safety release, the second detent in removable receipt of the second ball of the safety release;

a swivel having a swivel first end spaced apart from a swivel second end;

a swivel eyelet disposed in the swivel first end;

a hook ring selectively attaching the swivel eyelet to the hook pin eyelet end;

a pair of flat round rollers comprising a first roller and a second roller, the first roller held above the swivel second end and the second roller held below the swivel second end by a swivel pin;

a pair of opposed oblong mirror image plates comprising a top plate and a bottom plate;

the top plate having a top plate front spaced apart from a top plate rear;

a top interior channel within the top plate, the top interior channel exposed downwardly;

a top plate orifice proximal to the top plate front, the fork tube passed freely through the top plate orifice;

an insert port disposed within the top plate proximal to the top plate rear;

the bottom plate having a bottom plate front spaced apart from a bottom plate rear a bottom interior channel within the bottom plate, the bottom interior channel exposed upwardly;

a bottom plate orifice proximal to the bottom plate front, the fork tube passed freely through the bottom plate orifice;

a spacer disposed between the top plate and the bottom plate, the spacer substantially within a center of the plates;

a spacer orifice disposed between the top plate orifice and the bottom plate orifice, the fork tube passed freely through the spacer orifice;

the rollers of the swivel comprising a first roller and a second roller, the rollers held above and below the swivel second end by the swivel pin, the rollers selectively inserted into the insert port of the top plate, the rollers traveling freely within the channels of the top plate and the bottom plate;

a first mount lateral affixed atop the top plate;

a first mount vertical affixed perpendicularly upward to the first mount lateral, the first mount vertical affixed to the top frame member proximal to the top member first end;

a second mount lateral affixed atop the top plate;

a second mount vertical affixed perpendicularly upward to the second mount lateral, the second mount vertical identical to the first mount vertical, the second mount vertical affixed to the top frame member proximal to the top member first end.

* * * * *